US007332690B2

(12) United States Patent
Schmiedlin et al.

(10) Patent No.: US 7,332,690 B2
(45) Date of Patent: Feb. 19, 2008

(54) HOT WIRE IGNITER

(75) Inventors: Mark D. Schmiedlin, Columbia Station, OH (US); David J. Horvath, Aurora, OH (US)

(73) Assignee: Channel Products, Inc., Chesterland, OH (US)

( * ) Notice: Subject to any disclaimer, the term of this patent is extended or adjusted under 35 U.S.C. 154(b) by 31 days.

(21) Appl. No.: 11/451,082

(22) Filed: Jun. 12, 2006

(65) Prior Publication Data

US 2006/0228660 A1 Oct. 12, 2006

Related U.S. Application Data

(63) Continuation-in-part of application No. 10/655,399, filed on Sep. 5, 2003, now abandoned.

(51) Int. Cl.
*F23Q 7/22* (2006.01)
*F23Q 7/00* (2006.01)

(52) U.S. Cl. ..... 219/267; 219/260; 219/270

(58) Field of Classification Search ..... 219/267, 219/261, 260, 262, 263, 264, 265, 266, 268, 219/269, 270; *F23Q 7/22, 7/00*
See application file for complete search history.

(56) References Cited

U.S. PATENT DOCUMENTS

| | | | | | |
|---|---|---|---|---|---|
| 4,423,309 | A * | 12/1983 | Murphy et al. | ..... | 219/270 |
| 4,549,071 | A * | 10/1985 | Hatanaka et al. | ..... | 219/270 |
| 5,521,356 | A * | 5/1996 | Bauer | ..... | 219/270 |
| 5,750,958 | A * | 5/1998 | Okuda et al. | ..... | 219/267 |
| 6,064,039 | A * | 5/2000 | Kumada | ..... | 219/270 |
| 2005/0252903 | A1 * | 11/2005 | Maki et al. | ..... | 219/270 |

* cited by examiner

*Primary Examiner*—Daniel Robinson
(74) *Attorney, Agent, or Firm*—James A. Hudak

(57) ABSTRACT

A hot wire igniter for igniting a gaseous or atomized fuel is disclosed. The coil of the hot wire igniter is formed from a thin high temperature, iron, chromium, aluminum alloy having a center section that is tightly wound. The coil turns initially do not touch one another and each end of the coil is attached to a rod that is received within an insulator member. The rods are connected to a power source. The coil portion of the hot wire igniter is received within a gas collector box which is attached to the burner to be ignited. Application of the power source to the lead-in rods causes the coil of wire to reach a temperature in excess of the ignition temperature of the fuel mixture which surrounds same causing the ignition of the mixture.

13 Claims, 5 Drawing Sheets

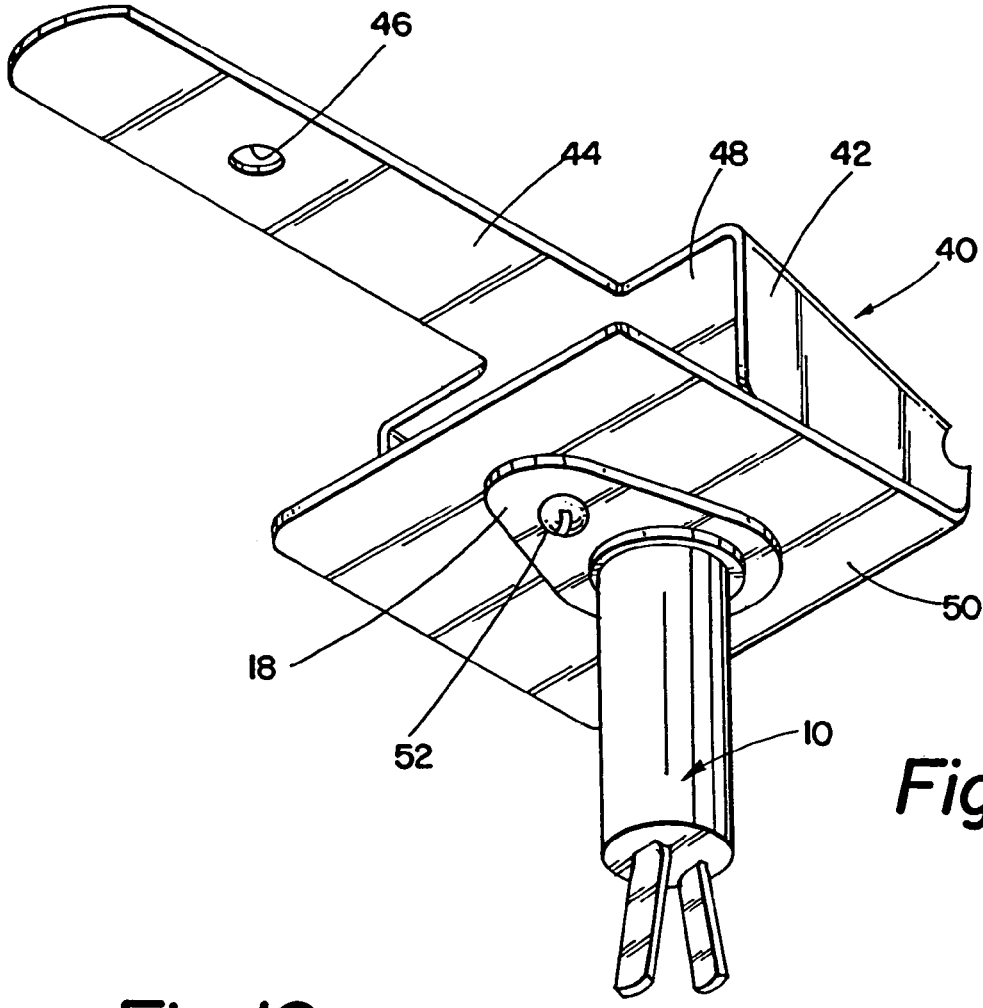
Fig. 9
Fig. 10
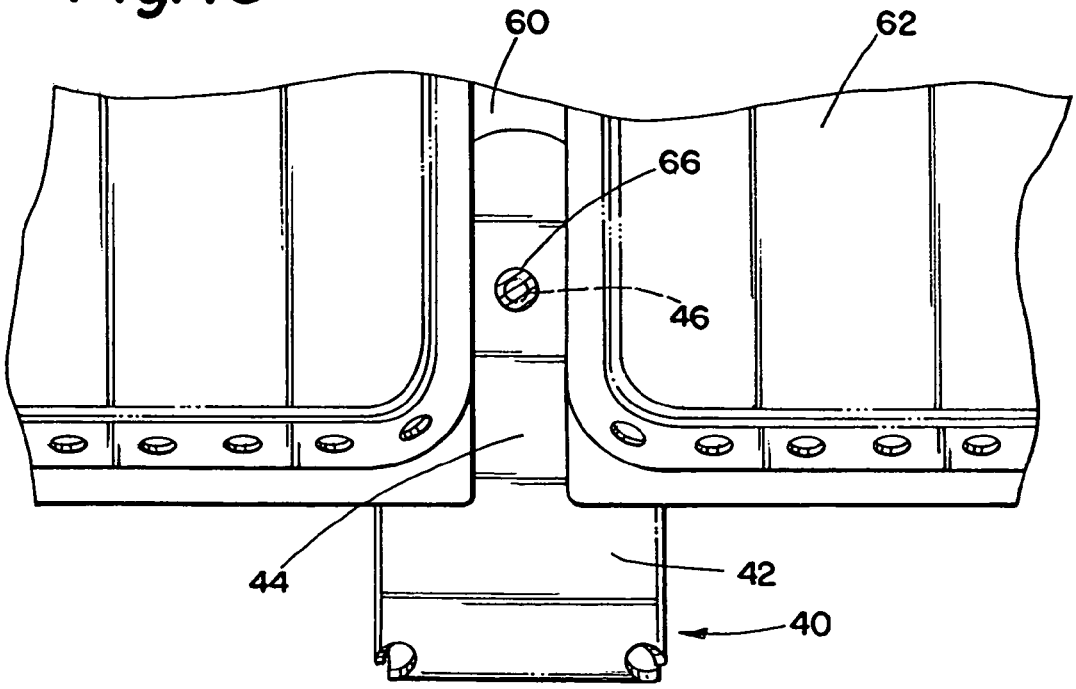

HOT WIRE IGNITER

This application is a continuation-in-part of application Ser. No. 10/655,399 filed on Sep. 5, 2003 now abandoned.

TECHNICAL FIELD

The present invention relates, in general, to an igniter and, more particularly, to a hot wire igniter that can be used for the ignition of a gaseous or atomized fuel in various types of appliances.

BACKGROUND ART

Gas grills typically utilize propane gas, natural gas or some type of manufactured gas as their fuel source and a spark ignition system to ignite same. Such a spark ignition system when used in gas grills or other gas appliances, such as pool water heaters, can be affected by environmental factors. For example, such a spark ignition system may operate erratically in a very damp and/or windy environment. Also, the operation of such a spark ignition system in a gas grill can be adversely affected by organic contamination from the foods being grilled. In addition, such a spark ignition system is noisy when actuated since it typically utilizes a piezoelectric impact-type igniter that is mounted on a sheet metal panel which effectively transmits the igniter actuation noise into the surrounding atmosphere. An electronic spark ignition device may be used which emits a series of spark pulses that produces a potentially annoying "ticking" sound. Furthermore, the routing and/or positioning of the electrical wiring within an appliance using a spark ignition system is critical since the heat generated within the appliance might adversely affect the wiring. Also, due to the high frequency nature of the spark produced by such ignition systems, the routing and/or positioning of the wiring within the appliance can affect the efficiency of the resulting spark. In addition, because such spark ignition systems produce high voltages, any defects in the wiring or any deterioration thereof can adversely affect the resulting spark.

In view of these disadvantages associated with presently available spark ignition devices, it has become desirable to develop another type of ignition device, such as a hot wire igniter, for igniting the fuel utilized within the appliance.

SUMMARY OF THE INVENTION

The present invention overcomes the problems associated with utilizing a spark ignition device for igniting a gaseous or atomized fuel by providing a hot wire igniter that operates at a significantly lower voltage and higher current than presently available spark ignition devices. In addition, the lower voltage does not include a high frequency component. The coil of the hot wire igniter of the present invention is formed from a thin high temperature, iron, chromium, aluminum alloy having a center section that is tightly wound. The coil has a unique geometry and each end of the coil is welded to a rod that is enclosed within an insulator member. The rods are typically connected to a DC power source. Alternatively, an AC power source or a chopped DC or chopped AC power source can be utilized as the power source. Application of the power source to the rods causes the coil of wire to reach a temperature in excess of the ignition temperature of the fuel mixture that surrounds and may penetrate same causing the ignition of the mixture. The use of a hot wire igniter, rather than a spark ignition device, permits the igniter to be used in very damp or windy environments. Thus, the hot wire igniter of the present invention can be readily used within a gas grill that is stored outdoors or a pool water heater that is used outdoors. In addition, the operation of the hot wire igniter of the present invention is not adversely affected by organic contamination from foods that are grilled in a gas grill or the sauces that may be used thereon since the surface of the hot wire igniter reaches a temperature that causes such contamination to be readily burned off and any leakage current resulting from organic contamination which would normally absorb or ground a high voltage spark and render it ineffective is insignificant.

BRIEF DESCRIPTION OF THE DRAWINGS

FIG. 9 is a perspective view of a typical gas collector box and showing the attachment of the typical embodiment of the hot wire igniter shown in FIG. 1.

FIG. 10 is an enlarged top plan view of a typical burner and a typical gas collector box having the coil portion of the typical embodiment of the hot wire igniter shown in FIG. 1 therein and showing the attachment of the gas collector box to the top surface of the burner.

DESCRIPTION OF THE PREFERRED EMBODIMENT

Figure 1:
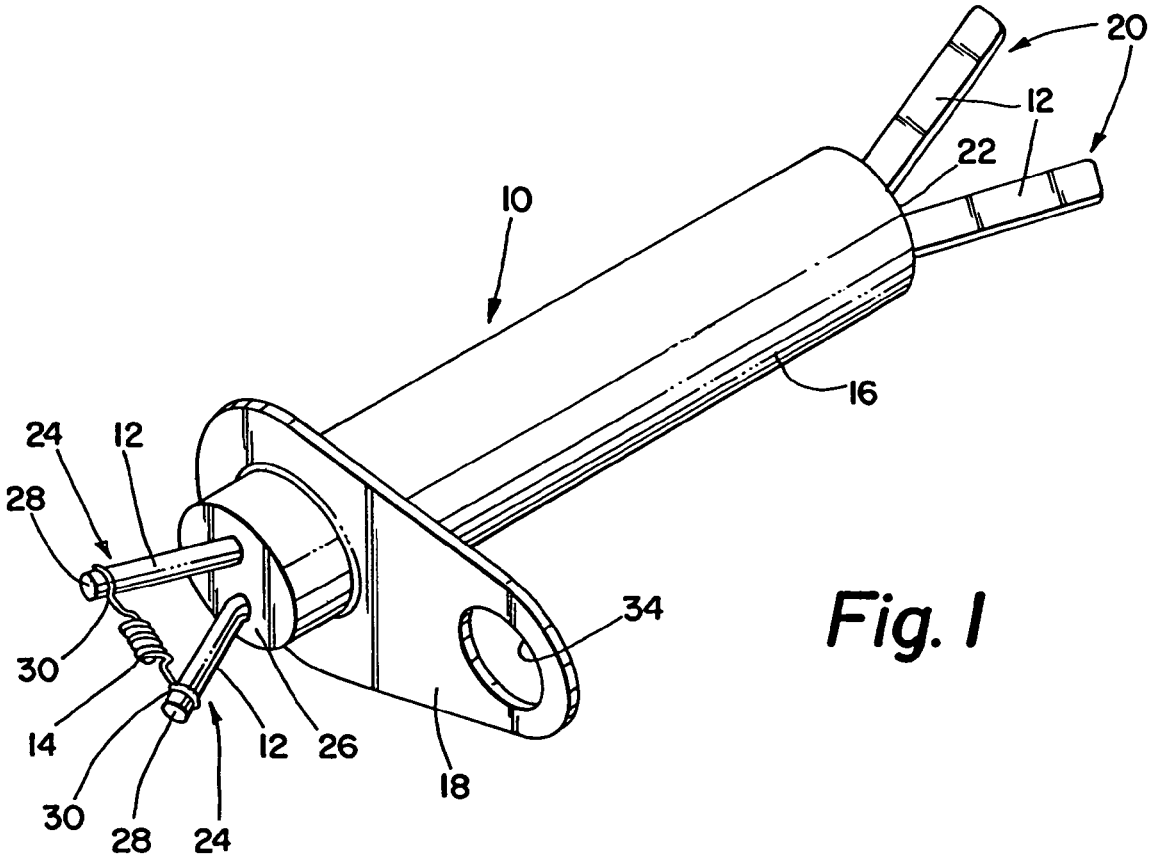
FIG. 1 is a perspective view of a typical embodiment of a hot wire igniter of the present invention.

Referring now to the Figures where the illustrations are for the purpose of describing the preferred embodiment of the present invention and are not intended to limit the invention described herein, FIG. 1 is a perspective view of a typical embodiment of the hot wire igniter 10 of the present invention. The hot wire igniter 10 is comprised of two (2) lead-in rods 12, a coil 14 of wire whose opposite ends are each attached to one of the ends of the rods 12, an insulator member 16 and a mounting bracket 18.

Figure 2:
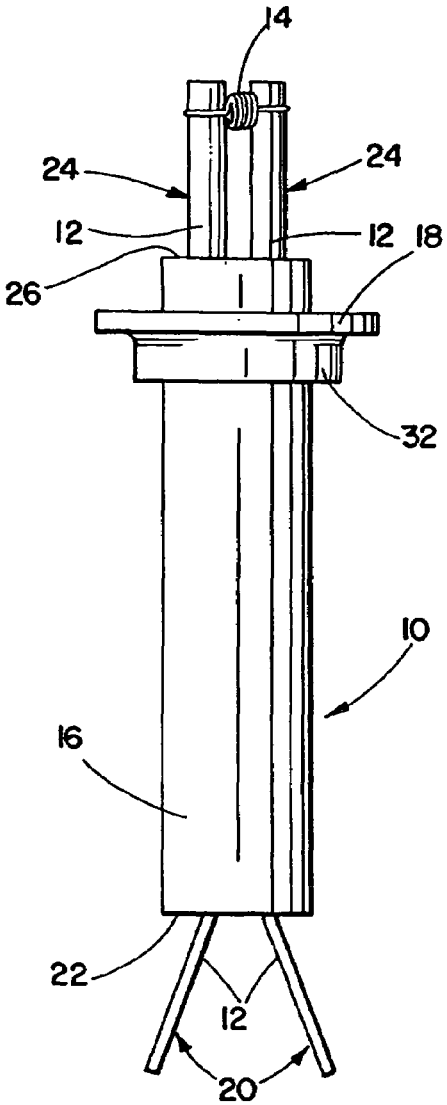
FIG. 2 is a front elevational view of the typical embodiment of the hot wire igniter shown in FIG. 1.
Figure 3:
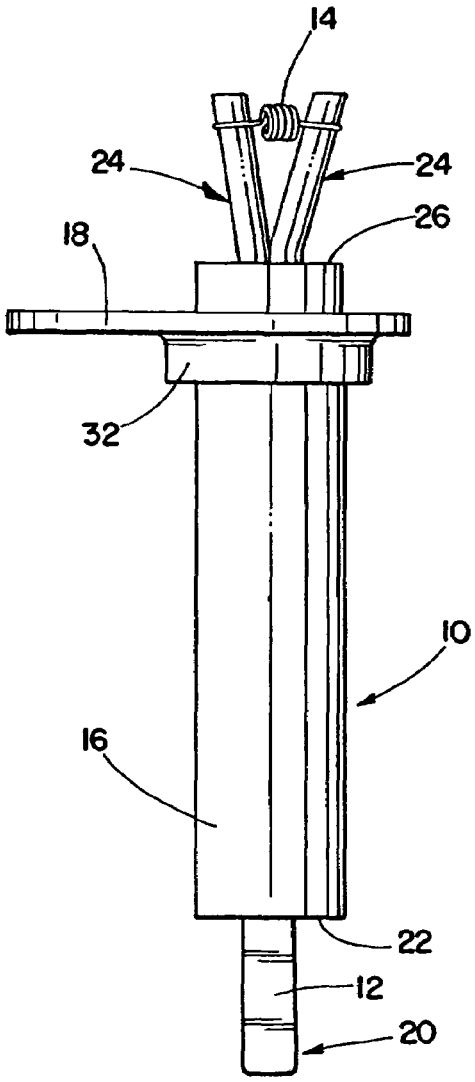
FIG. 3 is a right side elevational view of the typical embodiment of the hot wire igniter shown in FIG. 1; the left side elevational view being a mirror image of this Figure.
Figure 4:
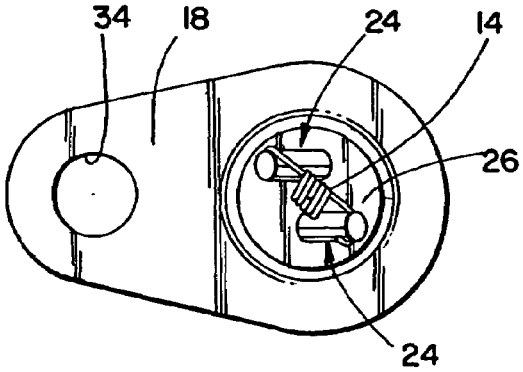
FIG. 4 is a top plan view of the typical embodiment of the hot wire igniter shown in FIG. 1.
Figure 5:
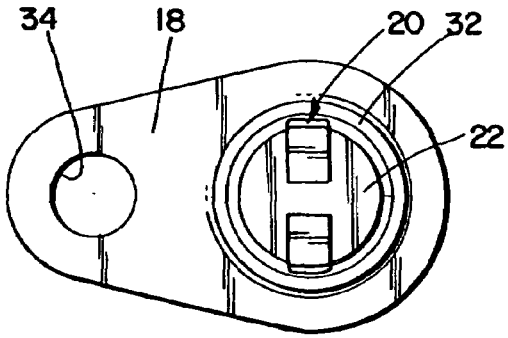
FIG. 5 is a bottom plan view of the typical embodiment of the hot wire igniter shown in FIG. 1.

The rods 12 are solid in construction, circular in cross-section and have an outer diameter of about 0.045 inches to 0.125 inches. The rods 12 are typically formed from nickel chrome (NiCr) material, an iron, chromium, aluminum alloy, stainless steel, or the like, and are received within substantially parallel longitudinally extending bores (not shown) provided within insulator member 16. The portions 20 of the rods 12 emanating from the end 22 of the insulator member 16 are usually swaged providing flat surfaces for the attachment of electrical terminals (not shown). In addition, the swaged portions 20 of rods 12 are usually bent outwardly with respect to one another permitting the easy attachment of the aforementioned electrical terminals. (Alternatively, the swaged portions 20 of the rods 12 can be eliminated and the electrical attachment thereto can be internal within the insulator member 16). The electrical terminals are connected to a power supply (not shown), such as a DC voltage source. Alternatively, the power supply can be an AC voltage source (not shown) or a chopped DC or AC voltage source (both not shown). The portions 24 of rods 12 emanating from the opposite end 26 of insulator member 16 are usually bent outwardly with respect to one another in order to provide a gap between the ends 28 thereof, as shown in FIG. 4. Each end 30 of coil 14 is welded to a rod 12 adjacent its end 28 and the coil 14 is positioned so as to be recessed within the gap provided between the ends 28 of the rods 12. As shown in FIGS. 2 and 3, the mounting bracket 18 includes a sleeve portion 32 which may have a compression member therein (not shown) to grippingly engage the outer surface of the insulator member 16. In addition, the mounting bracket 18 has an aperture 34 therein, as shown in FIGS. 1, 4 and 5, permitting the mounting of the igniter 10 within a collector box which is typically used in a gas grill that utilizes traditional spark ignition devices. Alternatively, the igniter 10 can be mounted directly to the burner within the grill or can be attached to the grill through a mounting or attachment arrangement.

Figure 6:
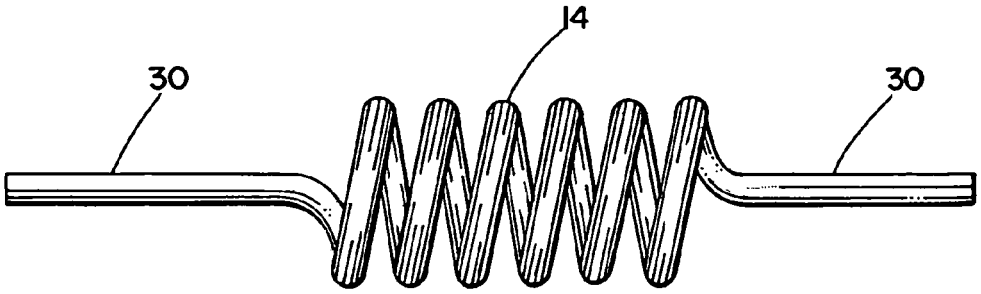
FIG. 6 is a front elevational view of the heating coil utilized in a typical embodiment of the hot wire igniter of the present invention.
Figure 7:
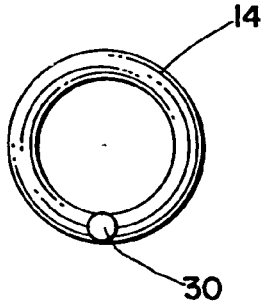
FIG. 7 is an end elevational view of the heating coil shown in FIG. 6.

The coil 14 is formed from an iron, chromium, aluminum alloy wire which can be subjected to temperatures from 1000° F. to about 2,500° F. The wire is typically 0.004 to 0.030 inches in diameter and the center section of the coil is tightly wound, as shown in FIG. 6. Typically, the coil 14 includes about six full coil turns, however, a lesser number of turns can be utilized. A minimum of two full coil turns is typically required to obtain the heat concentration that is provided by the adjacent coil turns. The coil turns typically have an outer diameter of about 0.030 to 0.250 inches and the overall length of the coil 14 is about 0.050 to 0.500 inches resulting in the ratio of the coil length to the coil outer diameter to be in the range of about 1.5:1 to 3:1. When formed, the coil turns typically do not touch one another and the ratio of the gap between adjacent coil turns to the thickness of the wire forming the coil 14 is about 0.50:1 to 2.5:1. The oppositely disposed ends 30 of the coil 14 are substantially straight and concentric with the longitudinal axis of the coil turns but offset therefrom so as to be positioned adjacent the outer radius of the coil turns. During the welding process, the coil 14 is oriented such that the coil turns are positioned substantially above the oppositely disposed ends 30 of the coil 14 in order to provide support and protection for the coil turns after the coil 14 has been welded adjacent to the ends 28 of the rods 12. It should be noted that the ratio of the outer diameter of the coil turns to the diameter of the rods 12 is about 0.5:1 to 6:1. During the conditioning and prove-in phase of the igniter 10, the coil 14 is heated by the application of a current source thereto for a pre-determined period of time annealing the coil 14 and causing a protective aluminum oxide coating to form on the surface of the coil 14. Through usage, the coil turns may contact one another. It should be noted that the protective oxide coating that forms on the outer surface of the iron, chromium, aluminum alloy wire utilized for coil 14 prevents electrical shorts if, because of coil sag and/or deformation due to usage and/or handling, adjacent coil turns touch one another during operation.

Suspending the coil 14 of wire between the rods 12 adjacent their ends 28 may cause the coil 14 to sag and/or deform through usage. The aforementioned geometry utilized for the coil 14 overcomes the problem of sag and/or deformation. In the present invention, the outer turns of the coil 14 heat the inner turns of same. The innermost coil turns typically experience the hottest temperatures and are the ones most likely to sag and/or deform when heated. Through usage, the innermost turns of the coil 14 may sag and/or deform but since these turns are of a relatively small radius, few in number, and are supported by the outer coil turns, the amount of sag and/or deformation is insignificant and, therefore, does not significantly affect the operation of the igniter 10. Any deformation of the coil turns that may occur allows the gas-air mixture to enter the gaps between adjacent turns to assist in the ignition of the gas-air mixture and compensates for any decrease in the operating performance of the coil 14 due to any increase in the electrical resistance of same through usage. It should be noted that the oppositely disposed ends 30 of the coil 14 radiate and/or conduct a substantial portion of the heat contained therein to the surrounding air and to the ends 28 of the rods 12 to which they are attached. By radiating and/or conducting such heat, the oppositely disposed ends 30 of the coil 14 are at a lower operating temperature than the coil turns, and thus, typically do not sag and/or deform. Because the heat is concentrated in the innermost coil turns, any coil sag and/or deformation is minimized and does not adversely affect igniter performance. It should be further noted that the coil 14 of wire can be immersed in the resulting flame without any adverse effects and readily operates within same.

Referring now to FIG. 9, a perspective view of a typical gas collector box 40 showing the attachment of the hot wire igniter 10 of the present invention thereto is illustrated. The gas collector box 40 is comprised of a housing 42 and a mounting bracket 44 attached thereto. An aperture 46 is provided in the mounting bracket 44. Gas collector box 40 has an opening, shown generally by the numeral 48, thereto. The bottom surface 50 of gas collector box 40 has an aperture (not shown) therein. The hot wire igniter 10 of the present invention is attached to the gas collector box 40 such that the portion of the insulator member 16 adjacent the end 26 thereof is received within the aperture (not shown) in the bottom surface 50 of gas collector box 40 and a fastener 52 is received through aperture 34 in mounting bracket 18 to firmly attach mounting bracket 18 to bottom surface 50 of gas collector box 40. In this manner, the portions 24 of the rods 12 emanating from the end 26 of insulator member 16 and the coil 14 attached thereto are within the gas collector box 40 and adjacent the opening 48 thereto.

Figure 8:
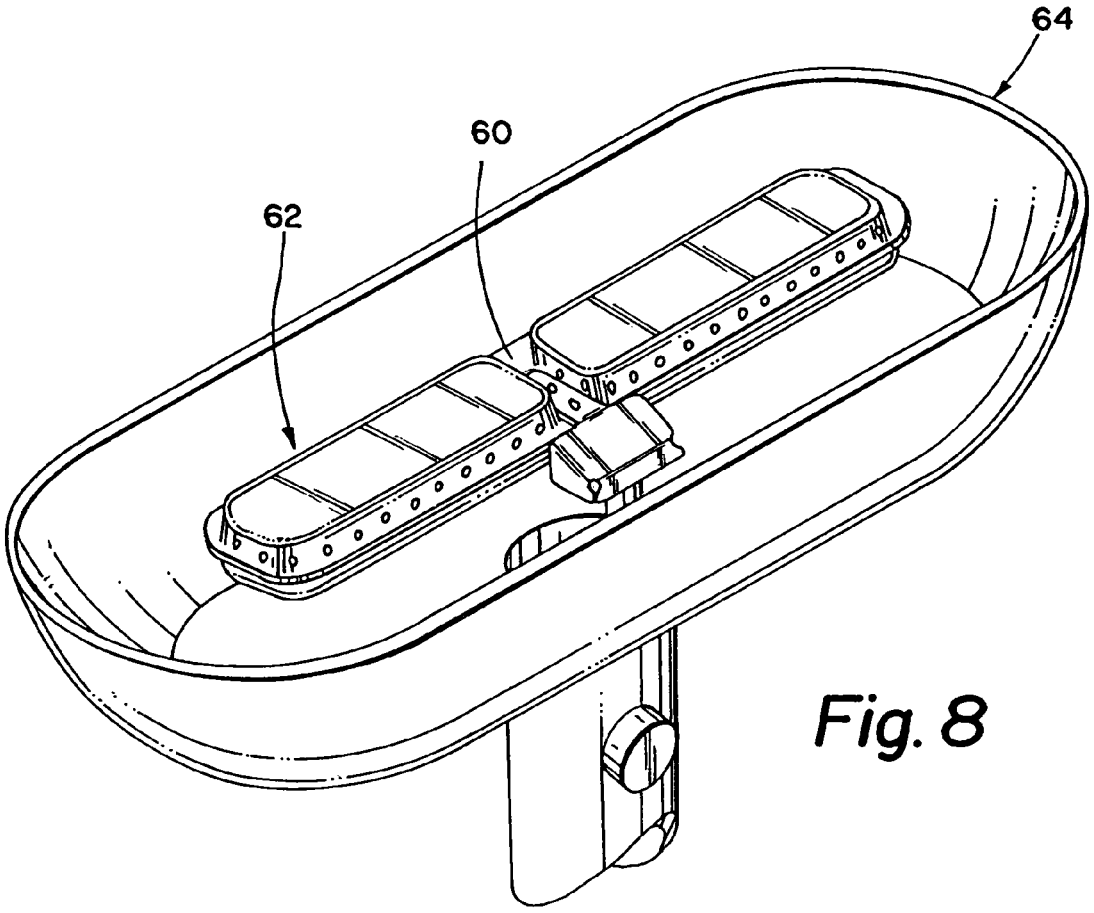
FIG. 8 is a perspective view of a typical gas collector box containing the typical embodiment of the hot wire igniter of the present invention and showing the attachment of the gas collector box to a typical burner within a gas grill.
Figure 11:
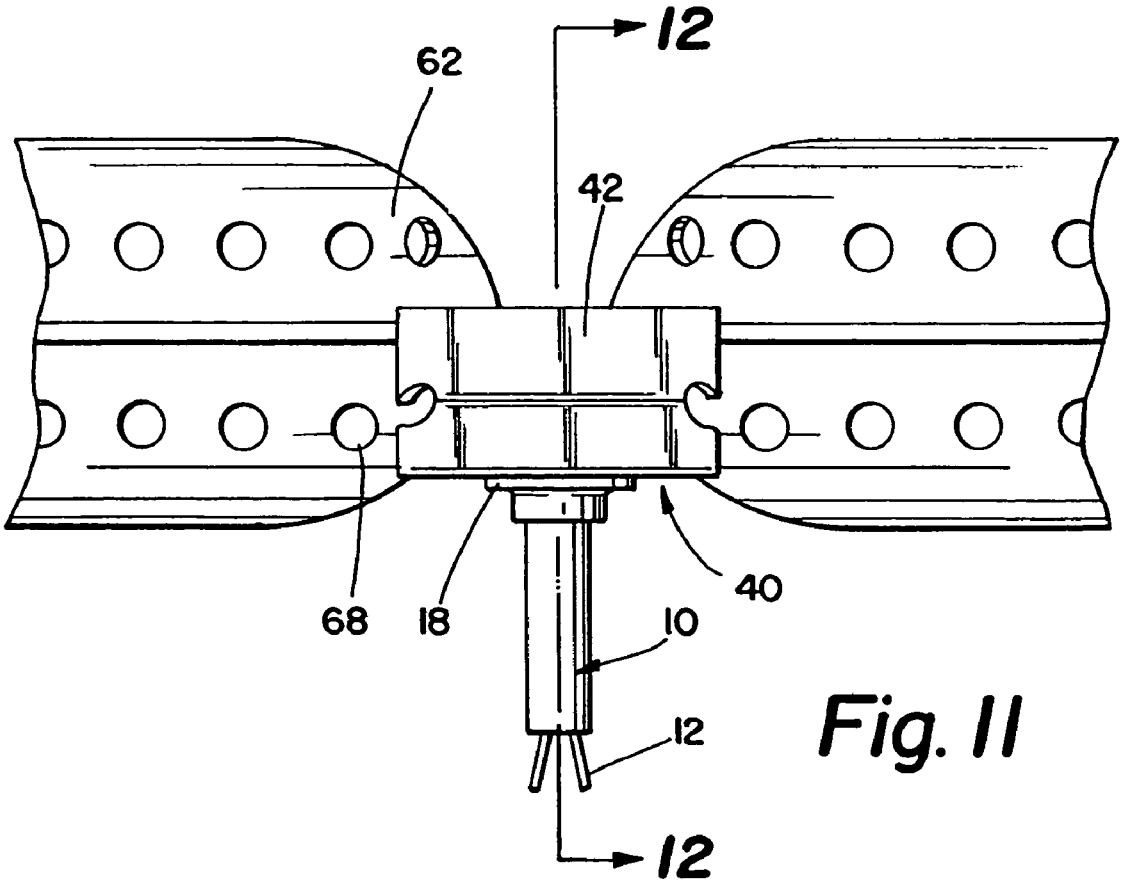
FIG. 11 is an enlarged front elevational view of a typical burner and a typical gas collector box containing the coil portion of the typical embodiment of the hot wire igniter shown in FIG. 1.
Figure 12:
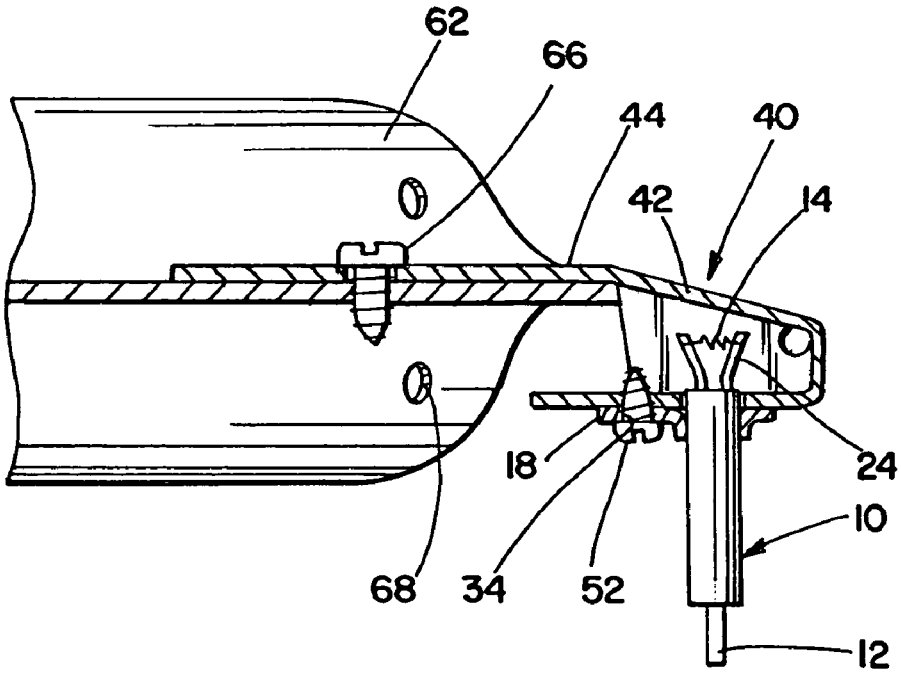
FIG. 12 is a cross-sectional view of the burner and the gas collector box taken across section-indicating lines 12-12 in FIG. 11.

In order to mount the gas collector box 40 with the igniter 10 attached thereto to a typical burner, the mounting bracket 44 is usually placed against the top surface 60 of the burner 62 in a gas grill 64, as shown in FIG. 8. A fastener 66 is then received within aperture 46 in mounting bracket 44 of gas collector box 40 to attach the gas collector box 40 and the igniter 10 to the top surface 60 of the burner 62, as shown in FIG. 10. In this manner, the opening 48 to the gas collector box 40 is adjacent the outlet ports 68 in the bottom portion of the burner 62, as shown in FIGS. 11 and 12. Gas emanating from ports 68 in burner 62 is received through the opening 48 to the gas collector box 40 and mixes with air therein permitting ignition of the gas-air mixture within the gas collector box 40 by the coil 14 of the igniter 10. The result is that the gas emanating from ports 68 in burner 62 is ignited within several seconds after power is applied to the igniter 10. It should be noted that the gas collector box 40 with the igniter 10 attached thereto can be mounted to the side surface or to the bottom surface of the burner 62, rather than to the top surface 60 thereof. Alternatively, the igniter 10 can be utilized without a gas collector box by mounting the igniter 10 directly to the burner 62 or to the body of the gas grill such that the coil portion thereof is adjacent to the outlet ports of the burner.

The hot wire igniter 10 of the present invention offers a number of advantages over presently available spark ignition systems for gas appliances. For example, the hot wire igniter 10 exhibits increased resistance to moisture, especially in those situations where the appliance is exposed to rain, and is resistant to carbon build-up on the coil 14. In addition, any degradation in the operation of the igniter 10 due to organic contamination, such as foods, sauces, etc., in a gas grill is not nearly as great as that which occurs for spark ignition devices since the igniter 10 burns off any such contaminants and any leakage current that results from organic contamination and which would normally absorb or ground the high voltage spark, rendering the igniter ineffective or making it inoperable, is insignificant. The coil 14 within the igniter 10 is also resistant to mechanical shock and vibration since it is formed from a metal alloy, rather than a brittle ceramic-like material, such as silicon carbide or silicon nitride igniters, and is protected because it is recessed between the ends 28 of the rods 12. Also, the protective oxide coating that forms on the outer surface of the coil 14 prevents electrical shorts if adjacent coil turns touch one another during operation. Furthermore, the routing and/or positioning of the wiring within the appliance when utilizing the igniter 10 is not as critical as the positioning of such wiring when a spark ignition device is utilized since the igniter 10 utilizes a very low voltage, 2 to 5 volts DC, which does not include a high frequency component for operating purposes. Alternatively, an AC power source or a chopped DC or chopped AC power source of any voltage can be utilized. In addition, operation of the igniter 10 is virtually silent when compared with the operation of spark ignition devices that typically utilize noisy piezoelectric impact-type devices to generate the required spark pulses. Such devices are typically mounted on a sheet metal panel which effectively transmits the actuation noise produced by the device into the surrounding atmosphere. If an electronic spark ignition device is used, the resulting series of spark pulses produces a potentially annoying "ticking" sound. Also, the igniter 10 may be less expensive to produce than presently available electronic spark ignition devices and is more reliable than such devices since it requires fewer parts. Lastly, the portion of the igniter 10 that includes the coil 14 is readily receivable within a collector box used for a spark ignition device permitting the easy replacement of such a spark ignition device by the igniter 10.

Certain modifications and improvements will occur to those skilled in the art upon reading the foregoing. It is understood that all such modifications and improvements have been deleted herein for the sake of conciseness and readability, but are properly within the scope of the following claims.

We claim:

1. An igniter comprising a tubular insulator member having a first end and a second end and having at least two spaced-apart bores therethrough, at least two rods each having a first end, a second end and an exterior surface and being formed from solid metallic material, each of said rods being received within one of said bores in said insulator member and being positioned therein so that a portion thereof having a substantially circular cross-section protrudes from said first end of said insulator member, said portion of at least one of said rods being bent outwardly with respect to said portion of said other rod forming a gap that increases in size in a direction transverse to the longitudinal axis of said insulator member extending from said first end of said insulator member to said first end of said rods, a high temperature wire strand having an outer diameter of about 0.004 inches to 0.030 inches and formed into a substantially straight coil of wire comprising at least two coil turns having a gap therebetween, said coil of wire terminating in a first end and an oppositely disposed second end of substantially straight wire, said first end and said oppositely disposed second end of said substantially straight wire being attached to the exterior surface of the portions of said rods protruding from said first end of said insulator member, the ratio of the overall length of said coil of wire to the overall outer diameter of said coil of wire being about 1.5:1 to 3.0:1, the ratio of said gap between adjacent coil turns of said coil of wire to said outer diameter of said high temperature wire strand forming said coil of wire being about 0.50:1 to 2.5:1, said high temperature wire strand being formed from an iron, chromium, aluminum alloy.

2. The igniter as defined in claim 1 wherein said outer diameter of said coil of wire is about 0.030 inches to 0.250 inches.

3. The igniter as defined in claim 1 wherein said overall length of said coil of wire is about 0.050 inches to 0.500 inches.

4. The igniter as defined in claim 1 wherein the outer diameter of said rods is about 0.045 inches to 0.125 inches.

5. The igniter as defined in claim 4 wherein the ratio of said outer diameter of said coil of wire to the outer diameter of said rods is 0.5:1 to 6:1.

6. The igniter as defined in claim 1 wherein said outer diameter of said coil of wire approximates the outer diameter of said rods.

7. The igniter as defined in claim 1 wherein said portions of said rods protruding from said second end of said insulator member are swaged permitting the attachment of a voltage source thereto.

8. The igniter as defined in claim 1 further including a bracket member having an aperture therein, said insulator member being grippingly received within said aperture in said bracket member.

9. An igniter comprising a tubular insulator member having a first end and a second end and having at least two spaced-apart bores therethrough, at least two rods each having a first end, a second end and an exterior surface and being formed from solid metallic material, each of said rods being received within one of said bores in said insulator member and being positioned therein so that a portion thereof having a substantially circular cross-section protrudes from said first end of said insulator member, said portion of at least one of said rods being bent outwardly with respect to said portion of said other rod forming a gap that increases in size in a direction transverse to the longitudinal axis of said insulator member extending from said first end of said insulator member to said first end of said rods, a high temperature wire strand formed into a substantially straight coil terminating in a first end and an oppositely disposed second end of substantially straight wire, said first end and said oppositely disposed second end of said substantially straight wire being attached to the exterior surface of the portions of said rods protruding from said first end of said insulator member, said high temperature wire strand being formed from an iron, chromium, aluminum alloy, and a collector box, said coil of wire and said portions of said rods protruding from said first end of said insulator member with said coil of wire attached thereto being received within said gas collector box and being positioned therein so as to ignite the gas-air mixture within said gas-collector box.

10. The igniter as defined in claim 9 wherein said gas collector box has an aperture therein for the receipt of the portion of the said insulator member containing said portions of said electrodes protruding from said end of said insulator member with said coil of wire attached thereto.

11. The igniter as defined in claim 9 wherein said gas collector box has an opening thereto permitting a gas-air mixture to be received therein.

12. The igniter as defined in claim 9 wherein said gas collector box further includes a mounting bracket attached thereto.

13. The igniter as defined in claim 12 wherein said mounting bracket attached to said gas collector box is attachable to a gas burner having outlet ports therein so as to position said gas collector box adjacent said outlet ports in said gas burner.

* * * * *